United States Patent [19]

Eaby et al.

[11] Patent Number: 4,986,764

[45] Date of Patent: Jan. 22, 1991

[54] HIGH VOLTAGE LEAD ASSEMBLY AND CONNECTOR

[75] Inventors: Daniel G. Eaby, Marietta; James P. Scholz, New Cumberland; David T. Shaffer, Mechanicsburg; Walter C. Shatto, Jr., Harrisburg; Brent D. Yohn, Newport, all of Pa.

[73] Assignee: AMP Incorporated, Harrisburg, Pa.

[21] Appl. No.: 429,446

[22] Filed: Oct. 31, 1989

[51] Int. Cl.[5] ..... H01R 13/00

[52] U.S. Cl. ..... 439/275

[58] Field of Search ..... 439/271–277

[56] References Cited

U.S. PATENT DOCUMENTS

| | | | |
|---|---|---|---|
| 3,163,692 | 12/1964 | Smith et al. | 264/249 |
| 3,266,007 | 8/1966 | Sullivan | 339/198 |
| 3,321,733 | 5/1967 | Thomas | 339/90 |
| 3,328,744 | 6/1967 | Fiske | 339/61 |
| 3,402,381 | 9/1968 | Gaw et al. | 339/94 |
| 3,475,720 | 10/1969 | Culver | 339/217 |
| 3,533,047 | 10/1970 | McFarlane | 339/94 |
| 3,550,064 | 12/1970 | Caller et al. | 339/65 |
| 3,681,739 | 8/1972 | Kornick | 339/94 C |
| 3,745,512 | 7/1973 | Johnson et al. | 339/59 M |
| 3,747,048 | 7/1973 | Johnson et al. | 339/75 R |
| 3,750,084 | 7/1973 | Gardner | 339/61 R |
| 3,787,796 | 1/1974 | Barr | 339/60 R |
| 3,794,958 | 2/1974 | Glover | 339/94 R |
| 3,824,526 | 7/1974 | Glover | 339/94 R |
| 3,842,389 | 10/1974 | Glover et al. | 339/60 M |
| 3,842,390 | 10/1974 | Glover et al. | 339/14 R |
| 3,842,393 | 10/1974 | Glover et al. | 339/60 M |
| 3,845,459 | 10/1974 | Normann | 339/191 R |
| 3,850,495 | 11/1974 | Glover | 339/60 M |
| 3,851,296 | 11/1974 | Muchmore et al. | 339/60 M |
| 3,880,487 | 4/1975 | Goodman et al. | 339/60 R |
| 3,963,295 | 6/1976 | Askman et al. | 339/60 R |
| 3,994,553 | 11/1976 | Kornick | 339/60 R |
| 4,090,759 | 5/1978 | Hermann, Jr. | 339/60 M |
| 4,154,496 | 5/1979 | Gallagher | 399/89 R |
| 4,417,736 | 11/1983 | Herrmann, Jr. | 277/212 R |
| 4,601,528 | 7/1986 | Spier | 339/38 |
| 4,605,272 | 8/1986 | Myers et al. | 339/60 M |
| 4,614,392 | 9/1986 | Moore | 339/94 R |
| 4,684,189 | 8/1987 | Swaffield | 439/587 |
| 4,834,678 | 5/1989 | Emadi et al. | 439/701 |
| 4,886,471 | 12/1989 | Fleshman, Jr. | 439/587 |

OTHER PUBLICATIONS

AMP Catalog 73-218 Revised 2-84, "LGH High Voltage Lead Assemblies, Connectors & Receptacles", pp. 2-5, 24-29, 55-56; AMP Incorporated, Harrisburg, Pennsylvania.

(List continued on next page.)

*Primary Examiner*—Joseph H. McGlynn
*Attorney, Agent, or Firm*—Anton P. Ness

[57] ABSTRACT

A pair of small diameter lead assemblies as a complete electrically and environmentally sealed matable high voltage connection suitable for use under rugged environmental conditions, have a plug element and a receptacle conditions, have a plug element and a receptacle element physically matable therewith. The lead assemblies can each include annular retention clips therearound enabling insertion into and retention within passageways of matable housings of a multi-terminal hybrid connector assembly, to enable certain existing connectors to be converted into use as high voltage connector assemblies for rugged conditions without housing modification. The plug has a small diameter dielectric annular shell with a socket terminal in an internal passageway; and the receptacle has a small diameter dielectric annular shell having a pin terminal in its internal passageway which is matable with the socket terminal. A forward receptacle portion of the receptacle surrounding the pin contact section snugly receives thereinto a forward reduced dimension plug portion of the plug. Spaced apart O-rings disposed along and tightly around the plug portion are compressed by the receptacle portion and assuredly seal the annular space therebetween, preventing generation of voltage discharge and minimizing corona formation thereat. The rearward passageway portions surrounding the existing conductor wires are potted to prevent voltage discharge and minimize corona formation thereat.

26 Claims, 3 Drawing Sheets

OTHER PUBLICATIONS

AMP Catalog 79-547 Revised 1-85, "Amplimite Subminiature D Pin & Socket Connectors per MIL--C-24308", pp. 14-16, AMP Incorporated, Harrisburg, Pennsylvania.

Two drawings of AMP Incorporated, No. 533182 & No. 533189, of Connector Housings.

Reynolds Catalog, "Subminiature High Voltage Connectors & Cable Assemblies", (1986); Reynolds Industries Incorporated, Los Angeles, Calif.

Row Catalog, "High Voltage In-Line Disconnects", 1-83, two pages; Rowe Industries, Toledo, Ohio.

ITT Cannon Catalog D-17, "D Subminiature Connectors", p. 37, Jan. 1986; ITT Cannon, Santa Ana, Calif.

HIGH VOLTAGE LEAD ASSEMBLY AND CONNECTOR

FIELD OF THE INVENTION

The present invention relates to the field of electrical connectors and more particularly to lead assemblies for use in high voltage, low current applications.

BACKGROUND OF THE INVENTION

Electrical connectors are frequently used to provide electrical connection in high voltage, low current energy systems, e.g., in systems carrying about 1000 volts up to about 50 Kv at one-half ampere or less, and the electrical transmission may be continuous or pulsed. Such connectors must operate with high reliability, often under severe environmental conditions. For example, connectors are frequently incorporated into high-voltage, electronic circuits located in hostile environments and must maintain peak performance within a broad temperature range and under diverse vaporous and gaseous conditions. In aircraft, such systems must have high reliability in a temperature range of from −55° to +125° C. and from sea level to 70,000 feet altitude, where ambient pressure is substantially lower than at sea level.

The primary problems with such high voltage applications are the discharge of voltage along a path from the connection to the environment, and the formation of corona (or voltage leakage) around the connection; both problems are aggravated under high altitude, extreme temperature conditions. Voltage discharge is a failure of the connector requiring connector replacement. Corona formation and voltage leakage commonly leads to degradation and possible breakdown of the dielectric insulation around the terminals and the conductors of the conductor wires, which commonly leads eventually to voltage discharge. To minimize corona formation and avoid voltage leakage and accompanying dielectric voltage breakdown, it is necessary that an assured airtight dielectric seal be established about the terminals in their mated condition, and at the termination of the terminals with their respective conductors.

In prior art connectors for high voltage, resistance to corona formation and resultant voltage discharge is built into the connector housings by careful selection of dielectric materials, housing structure design and assembly of the terminals into the housings. In one typical high voltage connector arrangement, the pin terminal is molded within a multi-terminal receptacle housing which is adapted to be mounted to a bulkhead, and the socket terminal is disposed within a multi-terminal plug housing. The housings are secured together after mating through a conventional coupling ring rotatably mounted on the plug housing and threadedly engageable with the cylindrical housing flange defining a receptacle wall surrounding a respective pin contact section of each pin terminal in the receptacle housing. Conventionally where the terminals are inserted into passageways of a premolded housing, the conductor wires exit from the rearward housing faces and potting material is used to seal the gap between the wire insulation and the housing; the potting material minimizes the possibility of voltage discharge from the rearward face of the connector.

In U.S. Pat. No. 4,886,471, the socket terminal is terminated to a conductor wire and a respective plug housing is molded therearound of silicone rubber, and has a long axial recess extending axially thereinto from the forward face thereof to receive force-fittably thereinto the receptacle wall of the mating receptacle housing so that the silicone rubber plug wall forces practically all air from the cavity and establishes a tight grip along the inside and outside surfaces of the rigid receptacle wall; the tight air-free grip is sufficient to establish assured sealing around the mated contact interface and also adequate resistance to unintentional decoupling without other fastening means but permit intentional decoupling under sufficient axial force.

In U.S. Pat. No. 4,834,678 previously molded connector housings are disclosed to be used to house high voltage, low current connections defined by multiple part assemblies placed in passageways of the housings having dimensions suitable for receiving larger diameter coaxial terminal assemblies. The multiple part assemblies are sold in kit form to be assembled by users following termination of the terminals to the conductor wires in the field; such assemblies are for use generally in non-extreme environments.

It is desired to provide lead assemblies of matable terminals on respective conductors each of which is removable and replaceable from a respective housing of a multi-terminal connector, where the lead assemblies when mated are especially adapted to prevent the occurrence of discharge events and minimize the level of corona formation in a high voltage application under rugged environmental conditions.

It is also desirable to provide such a mated lead assembly which is adapted for use in conjunction with a multi-terminal connector housing which need not be especially adapted for high voltage connections, including housings for both high voltage connections and low voltage signal connections, thereby enabling retrofit application with previously manufactured connector housings and also use with housings having a variety of design configurations.

It is further desirable that such lead assemblies be compact and lightweight and thus be especially suitable for aircraft applications.

SUMMARY OF THE INVENTION

The present invention provides an assembly of matable lead assemblies with mating pin and socket terminals terminated to respective conductors and which are disposed within respective dielectric shells which are matable with each other. One of the lead assemblies includes a first elongate cylindrical shell defining a plug element which is formed from a high-dielectric material and which has a metallic, electrically conductive socket terminal positioned within a forward open end thereof. The plug has a rearward end which is initially open to receive thereinto the end of a conductor wire soldered or otherwise electrically connected or terminated to the wire-connecting section of the socket terminal. Potting material is placed within the rearward open end of the plug to retain the terminal in the plug and to completely fill the space between the connector wire and the sidewall surfaces of the open end, and thereby prevent voltage discharge and minimize voltage leakage from the wire exit of the plug in a high voltage application. The plug shell has a thin shell wall having a general outer diameter along the plug section at the forward end which is dimensioned only large enough to provide a rigid wall of sufficient dielectric thickness surrounding the socket contact section of the terminal.

The lead assembly of the present invention further includes a second elongate cylindrical shell defining a receptacle element which is formed from a high-dielectric material and which includes an electrical pin disposed therewithin. The pin contact section is adapted to be snugly received within the socket contact section of the socket terminal of the plug, in surface to surface electrical contact therewith. The receptacle includes an annular wall which surrounds the electrical pin contact section, in spaced apart concentric relationship therewith, and which is dimensioned to be only incrementally larger than the outer diameter of the plug section of the plug element, to receive the plug section of the plug upon mating. The receptacle has a rearward end which is initially open to receive thereinto the end of a conductor wire terminated by the pin terminal, and be thereafter filled with potting material to retain the terminal therein and be sealed, similarly to the plug.

The receptacle shell has a thin shell wall of generally cylindrical shape, and has an outer diameter entirely therealong which is large enough for the receptacle section to receive the plug section of the plug element thereinto. Also the plug and receptacle elements rearwardly of the plug sections thereof need only have a general outer diameter sufficient for the rearward portions to receive insulatively jacketed portions of the respective conductors thereinto with enough of a gap to insert potting material therearound, defining a matable lead assembly having a low profile.

The matable lead assembly includes integral means for sealing against voltage discharge and voltage leakage, as well as providing for environmental sealing. Either the receptacle section of the receptacle includes sealing means therewithin adapted to seal upon mating with the plug, or the forward plug section of the plug includes sealing means therearound adapted to seal upon mating with the receptacle. The sealing means preferably comprises a plurality of O-rings of compressible high-dielectric, heat resistant material affixed to the plug section of the plug, adapted to be compressed by the associated inner surface of the receptacle section of the receptacle to provide an assured electrical and environmental seal around the mated contact sections during in-service use. The tight fit established by the compressible O-rings and the associated surface of the other element also provides resistance to unmating sufficient to retain the lead assemblies together in a vibration-resistant coupling without other coupling means.

Further, in the preferred embodiment each of the plug and receptacle elements also includes a C-shaped metallic retention spring clip snugly engaging an outwardly facing annular surface thereof within a shallow annular recess intermediate the lengths of the respective elements. Each retention clip has an annular array of circumferentially spaced apart fingers which are sprung from the remainder of the retention clip to extend obliquely outwardly and rearwardly therefrom. Because of the cylindrical minimized diameter design of the plug and receptacle shells each of the matable lead assemblies is therefore adapted to be inserted into a respective passageway of premolded conventional connector housings of the type which have annular forwardly facing stop surfaces, with the finger arrays being deflectable inwardly during insertion through a reduced diameter rearward portion of the housing passageway. Upon passing forwardly of the annular passageway stop surface defined by a larger diameter forward passageway portion, the tips of the spring fingers are engageable with the respective passageway stop surface to prevent rearward movement along the passageway especially during connector mating. With an appropriate tool inserted into the front of the housing passageway the spring fingers can be deflected inwardly and disengaged from the stop surface, permitting removal of the element from the housing enabling repair or replacement.

The plug and receptacle elements of the present invention are thus adapted to retain themselves within the respective housings of conventional design in a manner which permits removal from the housings enabling repair or replacement, thus enabling conventional housings to be used in high voltage connections without being modified to provide for sealing against voltage discharge and voltage leakage.

It is an objective of the present invention to provide matable electrical contact terminals to be disposed within matable dielectric shells having integral sealing means to define matable lead assemblies for an electrical connection suitable for high voltage, low current transmission even in the absence of connector housings.

It is also an objective to provide such lead assemblies for use in multi-terminal connector housings having conventional passageways of sufficient diameter, where the housings need not be especially adapted for use in high voltage applications and yet result in connectors suitable for high voltage application under rugged environmental conditions.

It is an additional objective to define high voltage lead assemblies for use in a hybrid connector assembly also having terminals for low voltage signal transmission, coaxial signal transmission, power transmission and/or fiber optic transmission.

It is further an objective to provide matable high voltage lead assemblies either of which is easily removed from its housing enabling repair and/or replacement, enabling continued use of the housing and other terminals therewithin.

For a further understanding of the present invention, attention is directed to the drawings and the following brief description thereof, to the detailed description of the preferred embodiment of the invention, and to the appended claims.

DETAILED DESCRIPTION OF THE PREFERRED EMBODIMENT

Figure 1:
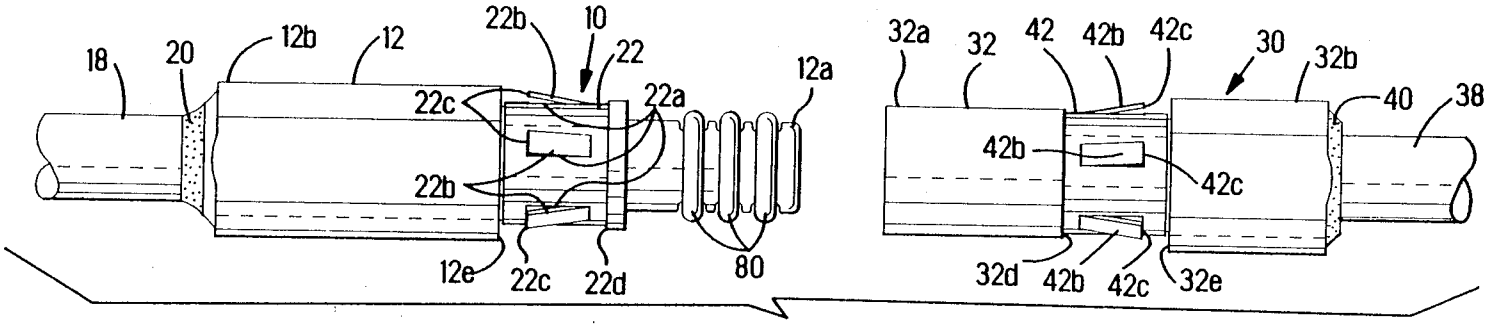
FIG. 1 is an elevational view of a plug and a receptacle of a lead assembly according to the preferred embodiment of the present invention having a socket contact and a pin contact therein respectively.
Figure 2:
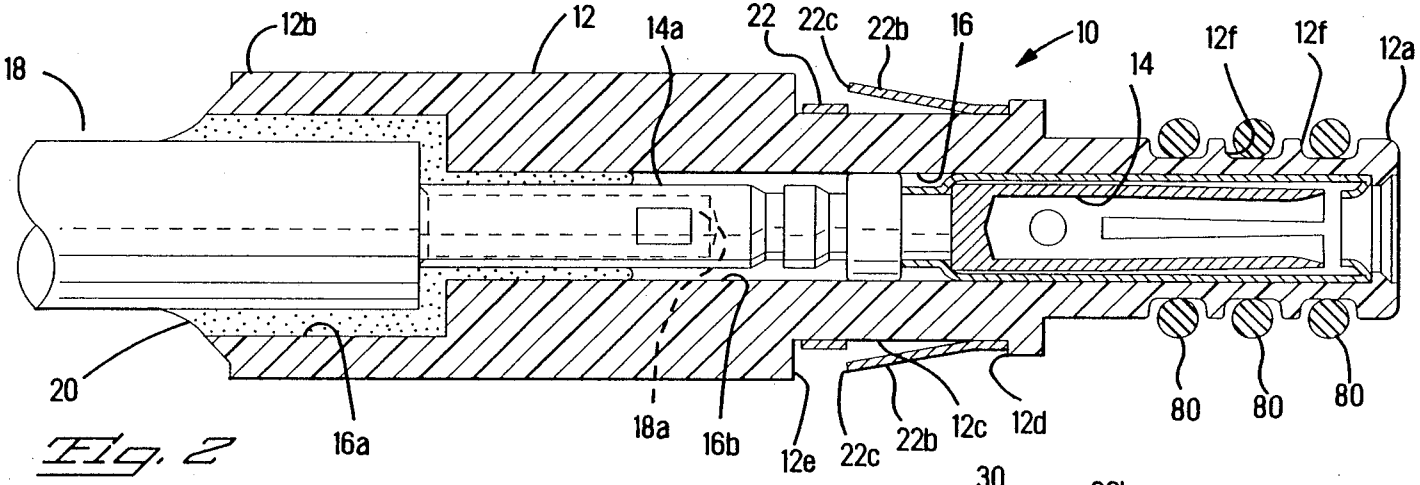
FIG. 2 is a view, partly in section, of the plug of FIG. 1.

FIGS. 1 and 2 illustrate a plug element of a lead assembly which is generally indicated by reference numeral 10 and which includes an elongate, annular member 12 with an electrically conductive, metallic socket 14 disposed along an internal passageway 16 which extends through the annular member 12. The metallic socket is positioned within the passageway 16 of the annular member 12 near an open forward end 12*a* of the member 12. The annular member 12, which is molded from an organic (or optionally formed from a ceramic) material with good electrical insulating and dielectric properties, also has an open rearward end 12*b* which is radially larger than the forward end 12*a*, and which defines a rearward portion 16*a* of the internal passageway 16 which is radially larger than the remaining portion 16*b* thereof.

The rearward portion 16*a* of the passageway 16 receives insertably thereinto the terminated end of an insulatively jacketed conductor wire 18, which is shown fragmentarily. For termination the stripped wire end 18*a* of the conductor wire 18 is inserted into a wire receiving barrel 14*a* of the socket 14, and is electrically connected to the barrel 14*a*, by soldering, crimping or the like, to provide a good, surface to surface electrical contact between the conductor of conductor wire 18 and the socket 14. As illustrated, the inside diameter of the rearward portion 16*a* of the passageway 16 is somewhat larger than the outside diameter of the insulated portion of the conductor wire 18 which it overlaps, to facilitate the assembly of the plug 10 and the conductor wire 18, and, after such assembly, the space within the rearward portion 16*a* of the passageway 16 and around the insulatively jacketed portion of conductor wire 18 is filled with a sealing means such as potting material 20 to seal such space and thereby eliminate potential paths for voltage discharge or leakage from the rear of plug 10; any incremental opening thereat would contribute greatly to corona formation and could lead to voltage discharge when the plug 10 is operated at a high voltage. Optionally a silicone rubber sealing sleeve could be force-fitted thereinto around wire 18.

Figure 3:
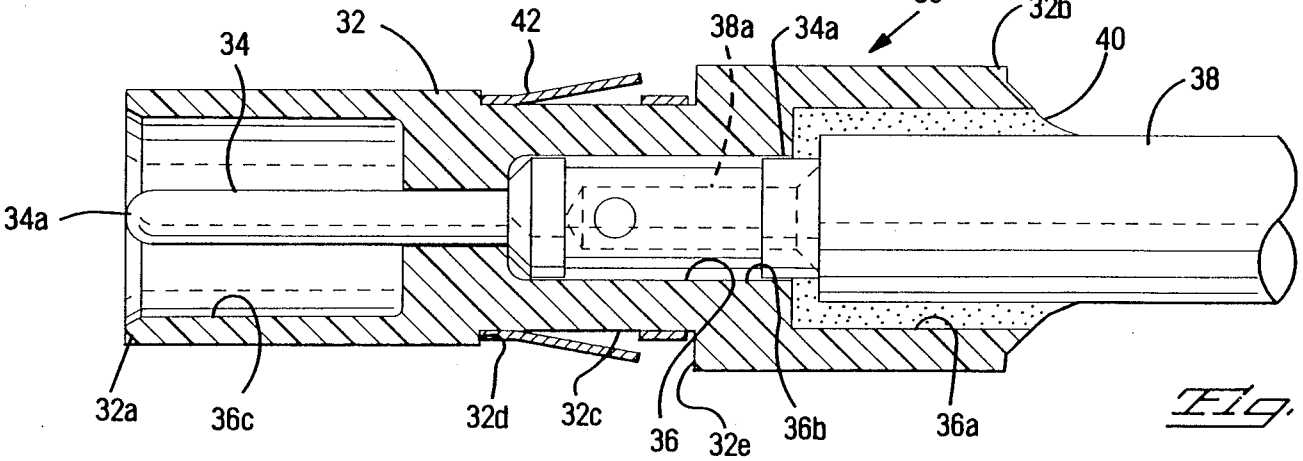
FIG. 3 is a view, partly in section, of the receptacle of FIG. 1.

FIGS. 1 and 3 illustrate a receptacle element 30 of the lead assembly, which includes an elongate, annular member 32 with an electrically conductive, metallic pin 34 disposed along an internal passageway 36 which extends through the annular member 32. The pin 34 is positioned within the passageway 36 of the annular member 32 with a pin contact section 34*a* of the pin being positioned near an open forward end 32*a* of the member 32, in substantial radial alignment therewith. The annular member 32, which is molded from an organic (or optionally from ceramic) material with good electrical insulating and dielectric properties, also has an open rearward end 32*b* and which defines a rearward portion 36*a* of the internal passageway 36 which is radially larger than an intermediate portion 36*b*, the passageway 36 also having a forward portion 36*c* which extends inwardly from the forward end 32*a* of the annular member for a substantial portion of the length of the pin contact section 34*a* and which is radially larger than the intermediate portion 36*b* thereof.

The rearward portion 36*a* of the passageway 36 receives insertably thereinto the terminated end of an insulatively jacketed conductor wire 38 the stripped wire end 38*a* of which is electrically connected to the wire-receiving barrel 34*b*, by soldering, crimping or the like. As illustrated, the inside diameter of the rearward portion 36*a* of the passageway 36 is somewhat larger than the insulated portion of the conductor wire 38 which it overlaps, to facilitate the assembly of the receptacle and the conductor wire 38. Similarly to the plug element, after such assembly the space within the portion 36*a* of the passageway 36 and the conductor wire 38 is filled with a sealing means such as potting material 40 to seal such space and thereby eliminate potential paths for voltage discharge or leakage from the rearward end of receptacle 30.

Each of the plug element 10 and the receptacle element 30 is shown to be provided with a C-shaped metallic retention spring clip which snugly surrounds and engages an outside surface thereof, the retention clip of the plug 10 being identified by the reference numeral 22 and the retention clip of the receptacle 30 being identified by the reference numeral 42. The retention clip 22 is precisely positioned axially of the plug 10 by providing the plug 10 with a reduced diameter portion 12*c*, between axially spaced apart and transversely extending shoulders 12*d* and 12*e*, and by trapping the retention clip 22 between the shoulders 12*d* and 12*e*. Likewise, the retention clip 42 is precisely positioned axially of the receptacle 30 by providing the receptacle 30 with a reduced diameter portion 32*c* between axially spaced apart and transversely extending shoulders 32*d* and 32*e*, and by trapping the retention clip 42 between the shoulders 32*d* and 32*e*.

Retention clips 22, 42 each have an annular array of spaced apart fingers 22*b*, 42*b* projecting obliquely outwardly and rearwardly therefrom, each of the fingers 22*b*, 42*b* being formed in the retention clip 22, 42 by a generally U-shaped cut 22*a*, 42*a*. Each of the fingers 22*b*, 42*b* has a radially outermost free end or tip portion 22*c*, 42*c* which is formed at the bight of the generally U-shaped cut 22*a*, 42*a* and which faces toward the respective conductor receiving end 12*b*, 32*b* of the respective annular member 12, 32.

Figure 4:
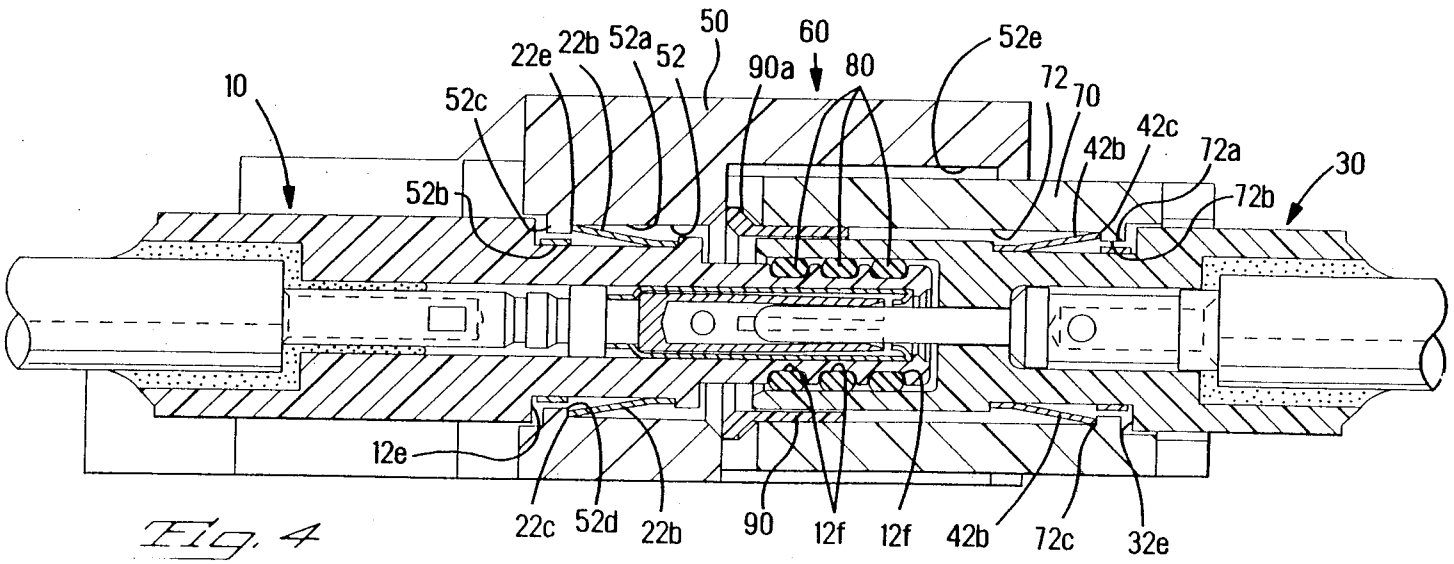
FIG. 4 is a view, partly in section of the receptacle of FIGS. 1 and 3 in mated relationship with the plug of FIGS. 1 and 2, and disposed within a respective connector housing also in mated relationship.
Figure 5:
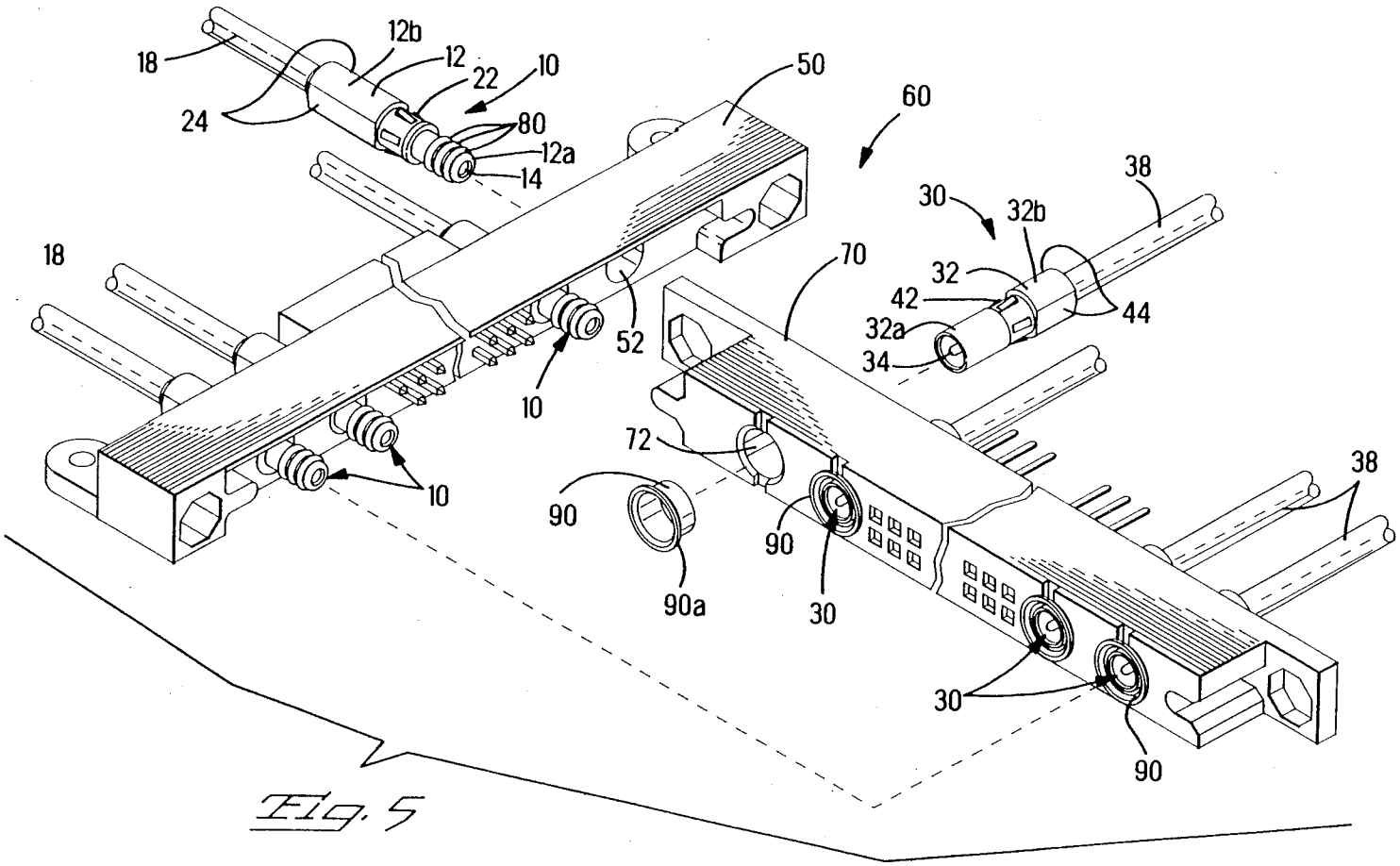
FIG. 5 is a perspective view of the connector assembly of FIG. 4, with a matable pair of high voltage plug and receptacle elements exploded therefrom.

Referring specifically to FIGS. 4 and 5, the plug 10 and the receptacle 30 are assembled in mating electrically conductive contact, with the pin contact section 34*a* of the pin 34 being matingly received within the socket contact section 14*a* of the socket 14 in a connector assembly 60. Connector assembly 60 is made up of a dielectric housing member 50 and a dielectric housing member 70, housings 50 and 70 being axially matable in conventional plug and receptacle housing fashion and include a plurality of other mating electrical contacts such as for low voltage signal or coaxial signal transmission or for power transmission. A connector assembly is sold by AMP Incorporated under Part Nos. 533182—3 and 533189—3 having such multi-terminal housings in which are securable Size 22pin and socket terminals in small diameter passageways and coaxial contact terminals in larger diameter passageways. Plug and receptacle elements 10, 30 of the present invention are shown for example adapted to be received within the larger diameter terminal-receiving passageways of such prior art connector housings, as shown in FIG. 5. Opposed chordal surfaces 24, 44 are shown along rearward portions 12*b*, 32*b* of annular members 12, 32 which act to prevent rotation of the plug and receptacle elements after insertion into the respective housing passageways 52, 72, in cooperation with associated chordal surfaces of larger diameter rearward passageway portions of the housings.

The housing member 50 has an internal lead-receiving passageway 52 with a small diameter portion 52*a* which surrounds the reduced diameter portion 12*c* of the annular member 12, the reduced diameter portion 52*a* being defined in part by a radially inwardly projecting annular flange 52*b*. The flange 52*b*, on an outwardly facing surface 52*c* thereof, engages the shoulder 12*e* of the annular member 12 of the plug to limit its travel into the housing member 50. Further, the flange 52*b*, on an inwardly facing surface 52*d* thereof, engages the tips 22*c* of the fingers 22*b* of the retention clip 22, after it resiliently deflects the fingers 22*b* during the insertion of the plug 10 into the passageway 52, to prevent the removal of the plug 10 from the housing member 50. Thus, the coaction between the outwardly facing surface 52*c* of the flange 52*a* in the passageway 52 of the housing member 50 and the shoulder 12*e* of the annular member 12 of the plug 10, and the coaction between the tips 22*c* of the fingers 22*b* of the retention clip 22 and the inwardly facing surface 52*d* of the flange 52*b*, precisely axially position the plug 10 and the housing member 50 relative to one another.

The internal passageway 52 of the housing member 50 also has a large diameter receptacle portion 52*e* which receives and surrounds a substantial axial length of the plug portion of the housing member 70. The housing member 70, in turn, has an internal passageway 72 which receives and surrounds a substantial portion of the receptacle 30, from the first end 32*a* of the annular member 32 past the shoulder 32*e* thereof. The passageway 72 of the housing member 70 has a radially inwardly projecting flange 72*a* which, on an outwardly facing surface 72*b* thereof, engages the shoulder 32*e* of the annular member 32 to limit the travel of the receptacle 30 into the housing member 70. Further, the flange 72*a*, on an inwardly facing surface 72*c* thereof, engages the tips 42*c* of the fingers 42*b* of the retention clip 42, after it resiliently deflects the fingers 42*b* during the insertion of the receptacle 30 into the passageway 72, to prevent the removal of the receptacle 30 from the housing member 70. Thus, the coaction between the outwardly facing surface 72*b* of the flange 72*a* of the passageway 72 of the housing member 70 and the shoulder 32*e* of the annular member 32 of the receptacle 30, and the coaction between the tips 42*c* of the fingers 42*b* of the retention clip 42 and an inwardly facing surface 72*c* of the flange 72*a*, precisely axially position the receptacle 30 and the housing member 70 relative to one another.

Other retention mechanisms could be used to retain annular plug and receptacle elements in respective housing passageways in a manner permitting removal, such as retention clips disposed within enlarged central passageway portions and having fingers extending forwardly to engage behind a rearwardly facing stop shoulder of the annular members, with the clip fingers deflectable outwardly by a tool inserted from rearwardly of the housing.

Axially aligned and spaced apart elastomeric O-rings 80 are positioned in the space between the portion of the inside surface of the annular member 32 which defines the portion 36*c* of the passageway 36 and the portion of the outside surface of the annular member 12 which it surrounds, to ensure a good electrical and environmental seal between the annular member 12 and the annular member 32, the O-rings 80 being initially positioned on the annular member 12 in annular grooves 12*f* thereon. Further, an annular thermoplastic stabilizer 90 is shown force-fitted into the forward end of passageway 72 of housing 70 and around the outside surface of the end portion 32*a* of the annular member 32, to center the forward end of receptacle section 32*a* within housing passageway 72. Stabilizer 90 preferably has an enlarged end portion 90*a* to enable removal to permit tool insertion during removal of receptacle 30 from housing 70.

In practice, the housing members 50, 70 of a connector assembly 60 with which the present invention is most useful will normally have a multiplicity of spaced apart internal passageways extending parallel to one another in one or more rows, each of which will receive a respective lead assembly. Such multi-terminal housings may be for hybrid connector assemblies as illustrated in FIG. 5, and are adapted to receive several sizes and types of contact terminals terminated onto respective conductors, such as for low voltage signal transmission, coaxial signal transmission, power transmission and even optical transmission by means of appropriately terminated optical fibers. With the present invention, such hybrid connector housings can be used to house lead assemblies for high voltage, low current connections without being adapted or modified at all, since the lead assemblies of the present invention integrally seal themselves upon connector mating and can be placed in passageways having a dimension heretofore suitable for receiving larger diameter coaxial terminal assemblies, as in U.S. Pat. No. 4,834,678.

In the manufacture of a lead assembly of the present invention the annular members 12 and 32 may be molded from glass-filled polyester resin such as VALOX 420 SEO (trademark of General Electric Company) or from a liquid crystal polymer, such as VECTRA LCP A130 polyester, 30% glass filled, which is available from Celanese Corporation, or ULTEM amorphous thermoplastic polyetherimide, which is available from General Electric Company. The O-rings are preferably formed of silicone rubber of sufficient durometer and fitted in grooves tightly around the plug section of annular member 12. The retention clips 22 and 42 are preferably formed from passivated stainless steel; the metallic socket 14 is preferably a screw machined copper member with a gold plating over nickel and having a passivated stainless steel protective hood around the socket contact section; the metallic pin 34 is preferably a bronze member with a gold plating over nickel; and the insulatively jacketed conductors 18 and 38 have a maximum outside diameter of 0.100 inch. Potting material 20, 40 is of the type for bonding both to the dielectric material used on annular members 12, 32 and to the type of insulative jacket used on high voltage, low current conductor wire. One useful potting material is RTV 511 silicone elastomer sold by General Electric Company, which will bond and seal with several commonly used types of conductor insulation material; such insulation material could be silicone rubber or it may be a jacket of polytetrafluoroethylene such as TEFLON (trademark of E. I. DuPont de Nemours & Co.) whose outer surface adjacent the termination has been roughened.

The embodiment described herein represents the preferred embodiment of the present invention. However, modifications may occur to an artisan which are in keeping with the spirit of the invention, and which are within the scope of the claims here and after set forth.

What is claimed is:

1. In combination, matable elements of a single-lead assembly suitable for use in a high voltage electrical circuit to electrically connect first and second electrical conductors to one another in an environment having at least substantial pressure variations, comprising:

a plug element, said plug element comprising:

a first annular member formed from a material having good insulating and dielectric properties, said first annular member having a first passageway extending threrethrough from a forward end to a rearward end thereof;

a socket terminal formed from an electrically conductive material adapted to be disposed in said first passageway of said first annular member at a location adjacent said forward end thereof, said socket terminal having a socket contact section which is disposed within a reduced dimensioned forward plug portion of said first annular member and is adapted to receive an elongate pin contact section thereinto through said forward end of said first annular member upon mating, said socket terminal further having a wire-connecting rearward portion which is adapted to be connected to a conductive portion of a first electrical conductor in electrically conductive relationship.

said rearward portion of said first passageway being larger transversely than the insulatively jacketed portion of the first electrical conductor to receive a first means to sealingly fill the first annular space after insertion thereinto of said first conductor terminated to said socket terminal, to thereby prevent voltage discharge and minimize corona formation thereat when the lead assembly is operated at high voltage; and a receptacle element, said receptacle element comprising:

a second annular member formed from a material having good insulating and dielectric properties, said second annular member having a passageway extending therethrough from a forward end to a rearward end thereof, and a pin terminal formed from an electrically conductive material adapted to be disposed in said passageway of said second annular member at a location adjacent said forward end thereof, said pin terminal having an elongate pin contact section which is surrounded by a portion of said second annular member and which forms a receptacle portion defining an elongate annular space around said pin contact section, said pin contact section of said pin terminal being adapted to be received in said socket contact section of said socket terminal upon mating into an electrically relationship therewith, said pin terminal further having a wire-connecting rearward portion which is adapted to be connected to a conductive portion of a second electrical conductor in electrically conductive relationship, said rearward portion of said second passageway being transversely larger than the insulatively jacketed portion of the second electrical conductor to receive a second means to sealingly fill the third annular space after insertion thereinto of said second conductor terminated to said pin contact terminal, to thereby prevent voltage discharge and minimize corona formation thereat when the lead assembly is operated at high voltage; and said reduced dimension plug portion of said first annular member being snugly received into said receptacle portion of said second annular member upon mating resulting in minimal gas contained therewithin upon mating, one of said receptacle portion and said plug portion including compressible sealing means secured against axial movement therealong and cooperable with a facing surface of the other of said receptacle and plug portions to be compressed thereby to define a tight fit therebetween at a plurality of axially spaced locations for retention of said plug and receptacle elements together and assured electrical and environmental sealing therebetween at a plurality of axially spaced locations, upon said plug portion being received into said receptacle portion during mating of said lead assemblies, whereby matable single-terminal plug and receptacle elements for a matable single-lead assembly are defined to be secured onto respective conductor wires and having integral retention and sealing means preventing voltage discharge and minimizing corona formation thereat during in-service use in extreme environments when terminated onto respective conductor wires and mated, independent of any housing member within which the single-lead assembly may be disposed.

2. A lead assembly according to claim 1 wherein said rearward portion of said second passageway is larger than another portion of said second passageway which is immediately adjacent thereto.

3. A lead assembly according to claim 1 wherein at least one of said first and second means for sealingly filling said rearward portions of said first and second passageways respectively, is potting material.

4. A lead assembly according to claim 1 wherein said first and second annular members are rigid so that said compressible sealing means is tightly compressible therebetween without deforming said first and second annular members to define a tight fit therebetween establishing substantial frictional resistance to unmating, and establishing assured high voltage electrical sealing suitable for use in low pressure environments at varying temperatures.

5. A lead assembly according to claim 1 and further comprising O-ring means positioned in said annular space and forming a seal between said first annular member and second annular member.

6. A lead assembly according to claim 5, wherein said O-ring means comprises a plurality of O-rings which are spaced apart from one another longitudinally along said plug portion of said first annular member.

7. A lead assembly according to claim 6, wherein said plug portion of said first annular member which is received in said annular space is provided with a plurality of outwardly facing, annular grooves which are spaced apart from one another longitudinally of said first annular member, each of said grooves receiving one of said O-rings in tight-fitting engagement about said plug portion.

8. A lead assembly according to claim 7, wherein said plug portion is provided with at least three said grooves each receiving a said O-ring thereinto.

9. A lead assembly according to claim 1 wherein said first and second annular members have outer surfaces adapted to be retained within respective passageways of connector housings by retention means upon insertion thereinto, in a manner permitting removal therefrom.

10. A lead assembly according to claim 9, wherein said second annular member has first and second spaced apart transversely extending annular shoulders and a recessed, cylindrical portion between said first and second shoulders thereof, and further comprising:

a second retention clip securely engaging said recessed, cylindrical portion of said second annular member, said second retention clip being C-shaped and having an annular array of circumferentially spaced apart fingers extending obliquely outwardly therefrom toward said second end of said second annular member, each of said fingers of said second retention clip having a radially outermost free end, the free ends of the fingers of said second retention clip being adapted to engage a forwardly facing annular shoulder along a lead-receiving passageway of a second housing member of the connector, when a portion of said receptacle element is inserted into said lead-receiving passageway of the second housing member, to prevent withdrawal of said receptacle element from the second housing member, one of said first and second shoulders of said second annular member being adapted to engage a surface of the second housing member to limit the advance of said receptacle element into the passageway of the first housing member, whereby said second annular element is adapted to be removably inserted into a lead-receiving passageway of a respective housing member not needing to be adapted for high voltage connections.

11. A lead assembly according to claim 9, wherein said first annular member has first and second spaced apart transversely extending annular shoulders and a recessed, cylindrical portion between said first and second shoulders thereof, and further comprising a first retention clip securely engaging said recessed, cylindrical portion of said first annular member, said first retention clip being C-shaped and having an annular array of circumferentially spaced apart fingers extending obliquely outwardly therefrom toward said rearward end of said first annular member, each of said fingers of said first retention clip having a radially outermost free end, the free ends of the fingers of said first retention clip being adapted to engage a forwardly facing annular shoulder along a lead-receiving passageway of a first housing member of a connector, when said first annular member is inserted into said lead-receiving passageway after said fingers are deflected inwardly to pass over said shoulder, to prevent withdrawal of said plug element from the first housing member, one of said first and second shoulders of said first annular member being adapted to engage a surface of the first housing member to limit the advance of said plug element into the passageway of the first housing member, whereby said first annular element is adapted to be removably inserted into a lead-receiving passageway of a respective housing member not needing to be adapted for high voltage connections.

12. A lead assembly according to claim 11, wherein said second annular member has first and second spaced apart transversely extending annular shoulders and a recessed, cylindrical portion between said first and second shoulders thereof, and further comprising:

a second retention clip securely engaging said recessed, cylindrical portion of said second annular member, said second retention clip being C-shaped and having an annular array of circumferentially spaced apart fingers extending obliquely outwardly therefrom toward said rearward end of said second annular member, each of said fingers of said second retention clip having a radially outermost free end, the free ends of the fingers of said second retention clip being adapted to engage a forwardly facing annular shoulder along a lead-receiving passageway of a second housing member of the connector, when said receptacle element is inserted into said lead-receiving passageway of the second housing member after said fingers are deflected inwardly to pass over said shoulder, to prevent withdrawal of said receptacle element from the second housing member, one of said first and second shoulders of said second annular member being adapted to engage a surface of the second housing member to limit the advance of said receptacle element into the passageway of the first housing member, whereby said first and second annular elements are adapted to be removably inserted into respective lead-receiving passageways of respective housing members not needing to be adapted for high voltage connections.

13. A lead assembly according to claim 1 wherein said rearward portion of said first passageway is transversely larger than all other portions of said first passageway.

14. A lead assembly according to claim 13 wherein said rearward portion of said second passageway is transversely larger than another portion of said second passageway which is immediately adjacent thereto.

15. A single-lead assembly suitable for use in a high voltage electrical circuit in an environment having at least substantial pressure variations, said single-lead assembly comprising:

a first conductor wire having a conductive end portion extending from an insulatively jacketed end portion;

a second conductor wire having a conductive end portion extending from an insulatively jacketed end portion;

a plug element, said plug element comprising:

a first annular member formed from a material having good insulating and dielectric properties, said first annular member having a first passageway extending therethrough from a forward end to a rearward end thereof; and a socket terminal formed from an electrically conductive material disposed in said first passageway of said first annular member at a location adjacent said first end thereof, said socket contact section of said socket terminal through said first end of said first annular member upon mating, said socket terminal onto said conductive end portion of said first electrical conductor passing through said rearward passageway portion, said rearward passageway portion around the insulatively jacketed conductor portion therewithin being filled with a first means sealing said rearward passageway portion to prevent voltage discharge and minimize corona formation thereat when said mated lead assembly is operated at high voltage;

a receptacle element, said receptacle element comprising:

a second annular member formed from a material having good insulating and dielectric properties, said second annular member having a passageway extending therethrough from a forward end to a rearward end thereof, and a pin terminal formed from an electrically conductive material disposed in said passageway of said second annular member at a location adjacent said first end thereof, said pin terminal having an elongate pin contact section which is surrounded by a receptacle portion of said second annular member which forms an elongate annular space therearound, said elongate pin contact section of said pin terminal being receivable in said socket contact section of said socket terminal in electrically conductive relationship therewith upon mating, said pin terminal further having a wire-connecting rearward portion which is terminated to said conductive end portion of said second conductor wire passing through said rearward end of said second passageway, said rearward passageway portion being filled with a second means sealing said rearward passageway portion to prevent voltage discharge and minimize corona formation thereat when said mated lead assembly is operated at high voltage;

said reduced dimension plug portion of said first annular member being snugly received into said receptacle portion of said second annular member upon mating to minimize gas contained therewithin upon mating, one of said receptacle portion and said plug portion including compressible sealing means secured against axial movement therealong cooperable and plug portions after mating at a plurality of axially spaced locations for assured electrical and environmental sealing therebetween at a plurality of axially spaced locations, upon said plug portion being received into said receptacle portion during mating of said lead assemblies; and said first and second annular members being rigid so that said compressible sealing means is tightly compressible therebetween without deforming said first and second annular members to define a tight fit therebetween establishing substantial frictional resistance to unmating, and establishing assured high voltage electrical sealing suitable for use in low pressure environments at varying temperatures, whereby a mated single-lead assembly is defined having integral retention and sealing means preventing voltage discharge and minimizing corona formation thereat during service use independent of any housing member within which the single-lead assembly may be disposed.

16. A lead assembly according to claim 15 wherein said second annular member has first and second spaced apart transversely extending annular shoulders and a recessed, cylindrical portion between said first and second shoulders thereof, and further comprising:

a second retention clip securely engaging said recessed, cylindrical portion of said second annular member, said second retention clip being C-shaped and having an annular array of circumferentially spaced apart fingers extending obliquely outwardly therefrom toward said second end of said second annular member, each of said fingers of said second retention clip having a radially outermost free end, the free ends of the fingers of said second retention clip being adapted to engage a forwardly facing annular shoulder along a lead-receiving passageway of a second housing member of the connector, when a portion of said receptacle element is inserted into said lead-receiving passageway of the second housing member, to prevent withdrawal of said receptacle element from the second housing member, one of said first and second shoulders of said second annular member being adapted to engage a surface of the second housing member to limit the advance of said receptacle element into the passageway of the first housing member, whereby said second annular element is adapted to be removably inserted into a lead-receiving passageway of a respective housing member not needing to be adapted for high voltage connections.

17. A lead assembly according to claim 15 wherein said rearward portion of said second passageway is transversely larger than another portion of said second passageway which is immediately adjacent thereto.

18. A lead assembly according to claim 15, further comprising O-ring means positioned in said second annular space and forming a seal between said first annular member and said second annular member.

19. A lead assembly according to claim 18, wherein said O-ring means comprises a plurality of O-rings which are spaced apart from one another longitudinally of said first annular member.

20. A lead assembly according to claim 19, wherein said plug portion of said first annular member is provided with a plurality of outwardly facing, annular grooves which are spaced apart from one another longitudinally of said first annular member, each of said grooves receiving one of said O-rings in tight-fitting engagement about said plug portion.

21. A lead assembly according to claim 20, wherein said plug portion is provided with at least three said grooves each receiving a said O-ring thereinto.

22. A lead assembly according to claim 15, wherein said first and second annular members have outer surfaces adapted to be retained within respective passageways of connector housings by retention means upon insertion thereinto, in a manner permitting removal therefrom.

23. A lead assembly according to claim 22, wherein said first annular member has first and second spaced apart transversely extending annular shoulders and a recessed, cylindrical portion between said first and second shoulders thereof, and further comprising:

a first retention clip securely engaging said recessed, cylindrical portion of said first annular member, said first retention clip being C-shaped and having an annular array of circumferentially spaced apart fingers extending obliquely outwardly therefrom toward said rearward end of said first annular member, each of said fingers of said first retention clip having a radially outermost free end, the free ends of the fingers of said first retention clip being adapted to engage a forwardly facing annular shoulder along a lead-receiving passageway of a first housing member of a connector, when said first annular member is inserted into said lead-receiving passageway after said fingers are deflected inwardly to pass over said shoulder, to prevent withdrawal of said plug element from the first housing member, one of said first and second shoulders of said first annular member being adapted to engage a surface of the first housing member to limit the advance of said plug element into the passageway of the first housing member, whereby said first annular element is adapted to be removably inserted into a lead-receiving passageway of a respective housing member not needing to be adapted for high voltage connections.

24. A lead assembly according to claim 23, wherein said second annular member has first and second spaced apart transversely extending annular shoulders and a recessed, cylindrical portion between said first and second shoulders thereof, and further comprising:

a second retention clip securely engaging said recessed, cylindrical portion of said second annular member, said second retention clip being C-shaped and having an annular array of circumferentially spaced apart fingers extending obliquely outwardly therefrom toward said rearward end of said second annular member, each of said fingers of said second retention clip having a radially outermost free end, the free ends of the fingers of said second retention clip being adapted to engage a forwardly facing annular shoulder along a lead-receiving passageway of a second housing member of the connector, when said receptacle element is inserted into said lead-receiving passageway of the second housing member after said fingers are deflected inwardly to pass over said shoulder, to prevent withdrawal of said receptacle element from the second housing member, one of said first and second shoulders of said second annular member being adapted to engage a surface of the second housing member to limit the advance of said receptacle element into the passageway of the first housing member, whereby said first and second annular elements are adapted to be removably inserted into respective lead-receiving passageways of respective housing members not needing to be adapted for high voltage connections.

25. A lead assembly according to claim 15, wherein said rearward portion of said first passageway is transversely larger than all other portions of said first passageway.

26. A lead assembly according to claim 25, wherein said rearward portion of said second passageway is transversely larger than another portion of said second passageway which is immediately adjacent thereto.

* * * * *

UNITED STATES PATENT AND TRADEMARK OFFICE

CERTIFICATE OF CORRECTION

PATENT NO. : 4,986,764

DATED : January 22, 1991

INVENTOR(S) : Daniel G. Eaby, et al.

It is certified that error appears in the above-identified patent and that said Letters Patent is hereby corrected as shown below:

Claim 1, Column 9, Line 44, after "electrically" insert --conductive--.

Claim 15, Column 12, line 41, after "said" (second occurrence) insert --socket terminal having a socket contact section which is adapted to receive an elongate pin contact section inserted into said--.

Claim 15, Column 12, line 44, after "terminal" insert --having a wire-connecting rearward portion which is terminated--.

Claim 15, Column 13, line 19, after "cooperable" insert --with a facing surface of the other of said receptacle--.

Claim 15, Column 13, line 38, change "service" to read --in-service--.

Signed and Sealed this

Eighteenth Day of January, 1994

*Attest:*

*Attesting Officer*

BRUCE LEHMAN

*Commissioner of Patents and Trademarks*